US006076876A

United States Patent [19]

Letourneau et al.

[11] Patent Number: 6,076,876

[45] Date of Patent: Jun. 20, 2000

[54] TWO-CUP BEVERAGE CARRIER

[75] Inventors: Richard Vincent Letourneau, Waterville, Me.; Mangat Rai Sharma, Jevnaker, Norway

[73] Assignee: The Chinet Company Technology, Waterville, Me.

[21] Appl. No.: 09/013,595

[22] Filed: Jan. 26, 1998

[51] Int. Cl.[7] ..... B65D 1/36

[52] U.S. Cl. ..... 294/143; 294/159; 206/564; 229/406

[58] Field of Search ..... 294/143, 144, 294/172, 159; 206/560, 561, 564; 229/406, 407, 902, 904; 220/23.8, 575, 576, 771; D7/619, 622

[56] References Cited

U.S. PATENT DOCUMENTS

| | | | |
|---|---|---|---|
| D. 236,575 | 9/1975 | Vigue . | |
| D. 247,123 | 1/1978 | Benes | D28/86 |
| D. 249,620 | 9/1978 | Vigue . | |
| D. 249,622 | 9/1978 | Vigue . | |
| D. 249,769 | 10/1978 | Vigue . | |
| D. 250,243 | 11/1978 | Vigue . | |
| D. 253,561 | 12/1979 | Vigue . | |
| D. 274,110 | 6/1984 | Vigue . | |
| D. 279,259 | 6/1985 | Bixler et al. | D9/341 |
| D. 289,010 | 3/1987 | Vigue . | |
| D. 290,580 | 6/1987 | Vigue . | |
| D. 302,114 | 7/1989 | Ashby . | |
| D. 302,122 | 7/1989 | Ashby . | |
| D. 309,258 | 7/1990 | Vigue . | |
| D. 319,579 | 9/1991 | Vigue . | |
| D. 331,008 | 11/1992 | Vigue | D9/341 |
| D. 378,477 | 3/1997 | Sussman | D7/552.2 |
| 2,826,346 | 3/1958 | Randall | 294/172 |
| 3,381,825 | 5/1968 | Bessett | 294/172 |
| 3,587,915 | 6/1971 | Theobald . | |
| 3,891,084 | 6/1975 | Elizondo-Garcia . | |
| 3,915,371 | 10/1975 | Crabtree . | |
| 4,033,489 | 7/1977 | Fowler | 294/159 |
| 4,208,006 | 6/1980 | Bixler . | |
| 4,218,008 | 8/1980 | Veilleux . | |
| 4,381,847 | 5/1983 | Bessett . | |
| 5,096,065 | 3/1992 | Vigue . | |
| 5,497,885 | 3/1996 | Sussman | 220/575 |
| 5,713,619 | 2/1998 | DuBois et al. | 229/406 |

*Primary Examiner*—Robert P. Olszewski
*Assistant Examiner*—Paul Chin
*Attorney, Agent, or Firm*—Connolly Bove Lodge & Hutz LLP

[57] ABSTRACT

A two cup carrier is described which stably accommodates two cups of any different size in two cup-receiving sockets. The tray is stabilized and strengthened by stabilizing legs and by a support gusset provided between the two cup-receiving sockets.

18 Claims, 3 Drawing Sheets

TWO-CUP BEVERAGE CARRIER

FIELD OF THE INVENTION

The invention relates to a beverage carrier, in particular, a two-cup beverage carrier composed preferably of molded pulp and having two sockets for receiving two beverage cups, legs for stabilizing the carrier in a standing position, and support structure provided between the cup-receiving sockets.

BACKGROUND AND PRIOR ART

Carriers for food and beverages are made of various materials, including molded pulp. In the process of pulp molding, an article is formed from a slurry of aqueous pulp fiber by applying vacuum to forming molds and screens, followed by drying of the formed article. It is known in the art to form food and/or beverage carriers of molded pulp.

Food and beverage carriers are used in many settings, for example take out food service, institutional food service, ball park food service, and the like. These carriers typically are shaped to accommodate one or more beverage cups, and optionally containers of food or other items in addition to beverage cups. See, e.g. U.S. Pat. Nos. 4,208,006 and 4,381,847.

Many cup carriers in the prior art provide sockets for four cups. When only two cups need to be carried, these carriers use excess material and take up unnecessary storage space.

Two-cup carriers formed of folded cardboard are known in the art, with an integral carrying handle also formed of cardboard. An example of this type of construction is shown in U.S. Pat. No. 3,891,084. While this type of carrier is suitable for many purposes, it tends to lack solidity and rigidity, and normally does not provide for gripping on the side of the carrier.

The following disclosures are mentioned as representative of the prior art: U.S. Pat. No. 5,096,065; U.S. Pat. No. 4,218,008; U.S. Pat. No. 3,915,371; U.S. Des. Pat. No. 302,114; U.S. Des. Pat. No. 290,580; U.S. Des. Pat. No. 289,001; U.S. Des. Pat. No. 253,561; U.S. Des. Pat. No. 250,243; U.S. Des. Pat. No. 249,769; U.S. Des. Pat. No. 319,579; U.S. Des. Pat. No. 309,258; U.S. Des. Pat. No. 274, 110; U.S. Des. Pat. No. 302,122; U.S. Des. Pat. No. 249,622; U.S. Des. Pat. No. 249,620; and U.S. Des. Pat. No. 236,575.

SUMMARY OF THE INVENTION

An object of the invention is to provide a two cup carrier which accommodates cups of differing sizes and which is rigid and stable.

The invention provides for a two-cup beverage carrier having two cup-receiving sockets, which sockets can accommodate, in a stable and secure manner, a variety of cup sizes. To securely hold the cups, the cup-holding sockets are provided with flexible elements which are depressed by insertion of the cup, and which exert a stabilizing force to hold the cup in place.

The carrier has an upper surface and a lower surface, defining the top and bottom levels of the carrier, respectively. When a beverage cup is inserted into a socket, it rests against the lower surface. A support gusset having a stepped or multi-stepped structure is provide to add strength and rigidity to the carrier between the sockets. Associated with the sides of the carrier are stabilizing legs, which can also serve as grasping means. The stabilizing legs extend from the upper surface to the lower surface of the carrier.

DESCRIPTION OF THE PREFERRED EMBODIMENTS

Figure 1:
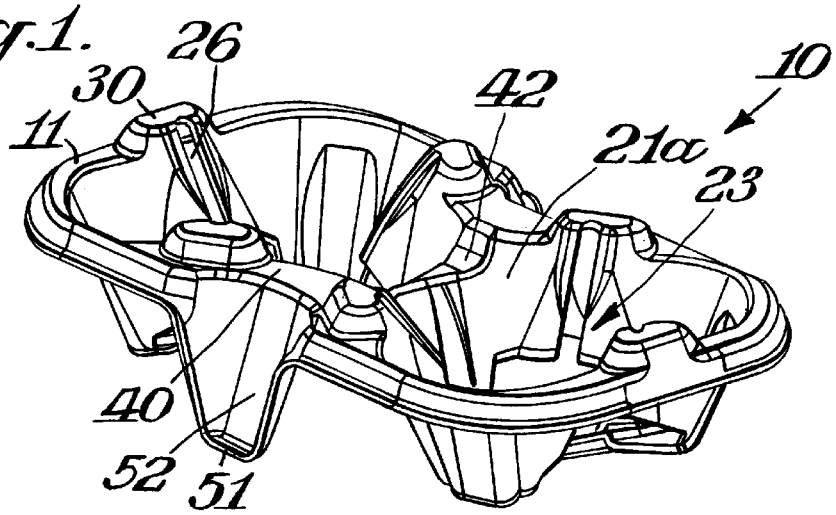
FIG. 1 shows a perspective view of a first embodiment of the two cup carrier of the invention.

The carrier of the invention may be fabricated from any material which can be formed to give a sturdy yet preferably lightweight construction. Molded pulp is preferred, although plastic is also suitable.

Pulp molding of articles such as food and beverage containers having sockets for receiving food and/or beverages is well known in the art, and is not described in detail herein. Reference can be made to, for example, U.S. Pat. No. 4,218,008, the disclosure of which is incorporated by reference.

Referring to the drawings, a first embodiment of the invention will be described with reference to FIGS. 1–5.

A two cup carrier 10 comprises an upper surface 11 and a lower surface 12. The upper surface 11 comprises a generally flat upper rim which extends around the perimeter of the carrier. The carrier is partially surrounded by a downwardly extending flange 13 which adds rigidity to the tray.

The carrier is provided with two cup-holding sockets 20, formed by inwardly-extending, downwardly-sloping walls 21 connecting the upper surface 11 and the lower surface 12. As described more fully below, the sockets are formed to accommodate a variety of sizes of beverage cups or cans, including the large 44 ounce cups which are currently popular.

The cup-holding sockets 20 are provided with at least one flexible element which is deformed by insertion of a cup into the socket, and which provides a resilient force against the cup which acts to hold the cup firmly in place in the socket. Both molded pulp and light plastic can exhibit the desired resiliency. In preferred form, the flexible element comprises a flexible flange 23, which extends from the upper surface, or from above the upper surface, down into the cup socket. The flange 23 extends partially into the socket but does not reach the level of the lower surface, which results in an open gap 24 between the lower edge of flange 23 and the lower surface 12.

Figure 2:
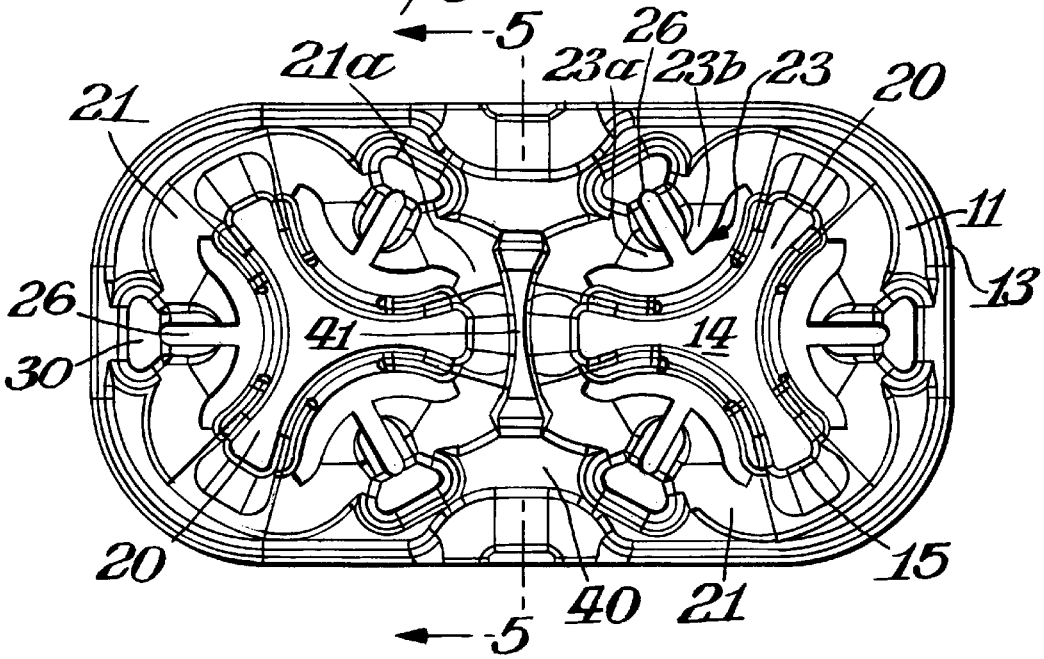
FIG. 2 is a top plan view of the embodiment shown in FIG. 1.

In the bottom of each socket is provided a floor 14 on which the cup sits when inserted. The floor 14 can be provided with raised notches 15 which fit with the lower edge of smaller sizes of cups to help prevent movement of the cup. As seen in FIG. 2, the floor 14 merges into sidewalls 21 at junction 15.

Figure 3:
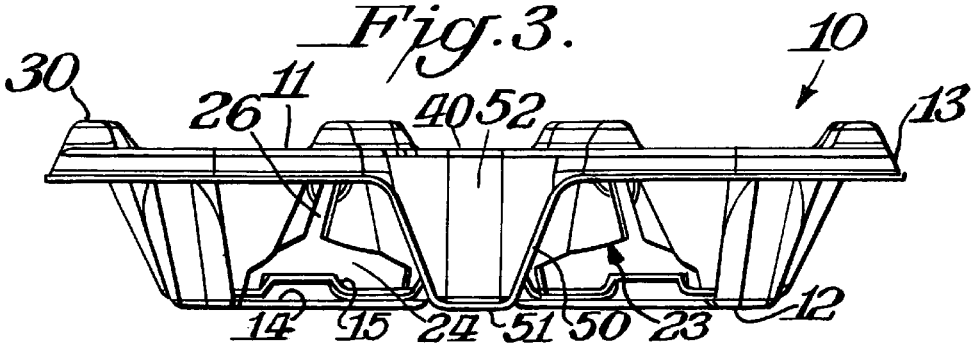
FIG. 3 is a side elevational view of the embodiment shown in FIG. 1.
Figure 4:
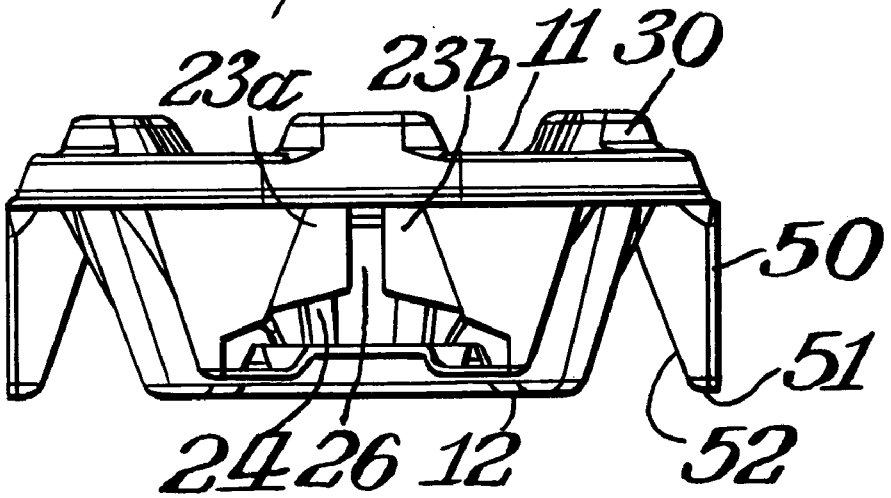
FIG. 4 is an end elevational view of the embodiment shown in FIG. 1.
Figure 5:
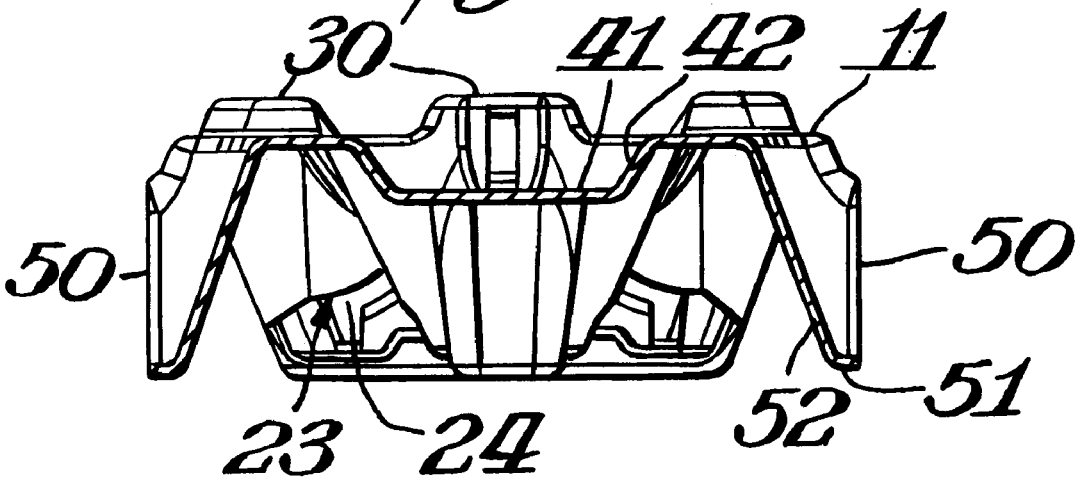
FIG. 5 is a cross-sectional end elevational view of the embodiment of FIG. 1 taken along line 5—5 in FIG. 2.

Referring again to the cup-holding sockets 20, in a preferred form the flexible elements 23 are provided with a slot 26, which divides the flexible flange 23 into flanges 23*a* and 23*b*. As shown in FIGS. 2 and 3, the slot 26 and gaps 24 together form an opening having the general appearance of an inverted "T". This type of configuration is particularly adapted to holding cups of different sizes in a secure manner, as is disclosed in U.S. Pat. No. 4,218,008.

The upper surface may be provided with elevated structures 30, which extend above the upper surface of the carrier. As shown, the slots 26 continue up into the elevated structures 30, which allows for additional flexible tension on the cup being held without increasing the overall height of the carrier and adds additional rigidity to the carrier structure.

In the preferred embodiment shown, each cup-holding socket is surrounded by three elevated structures 30, each of which is associated with a downwardly extending flexible flange 23 which is bisected by a slot 26. Although this particular configuration is preferred, the number and arrangement of the flexible means for securing the cup in the cup-holding socket can be varied.

In the upper surface 11 between the two cup-holding sockets 20 are provided shelves 40. The shelves 40 can form part of the generally flat upper surface 11. As seen in FIG. 2, the shelves 40 are generally wider than other areas of the upper surface 11.

In the middle of the tray between the sockets is provided support gusset 41. The upper surface of support gusset 41 is lower than the height of the upper surface 11 of the carrier. As seen in FIGS. 1 and 2, the sidewalls 21*a* which adjoin the support gusset 41 are thus shorter than the other sidewalls 21. The support gusset 41 should be formed such that the top of the support gusset 41 has a width of about ⅛ inch to about ¾ inch. Having this thickness, the support gusset confers additional strength to the carrier when loaded. The top of support gusset 41 connects to shelf 40 by sloping wall 42. While this arrangement is preferred, it will be apparent that the support gusset could take different forms. For example, the top of the support gusset could be either below or above the upper surface 11 of the carrier.

Each side of the carrier is provided with support legs 50, at substantially the midpoint of the length of the carrier. The legs extend to a leg bottom 51, on the same level as the lower surface 12 of the tray. Thus, when the carrier is sitting on a flat surface, both the lower surface 12 and the bottoms 51 of legs 50 are in contact with the surface, and the legs act to stabilize the tray against tipping. As can be appreciated, the legs will also help to stabilize the carrier when sitting on uneven surfaces.

Inwardly-extending or inwardly-curving wall 52 is provided in the legs which joins the upper surface of the carrier in the region of shelves 40 to the bottom 51 of the legs. Being depressed inwardly, the wall 52 allows the legs to be used as gripping handles for carrying the carrier, if desired. In particular, a user's thumb and forefingers can securely grasp the tray for carrying using one or both of the legs 50.

Figure 6:
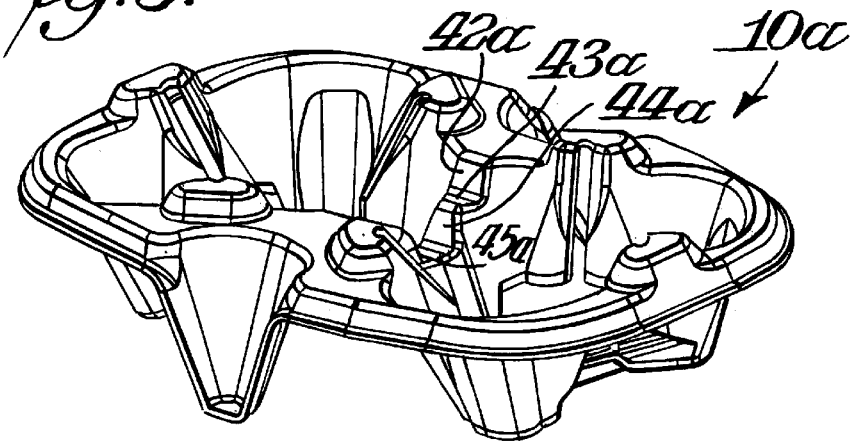
FIG. 6 is a perspective view of a second embodiment of the two cup carrier of the invention.
Figure 7:
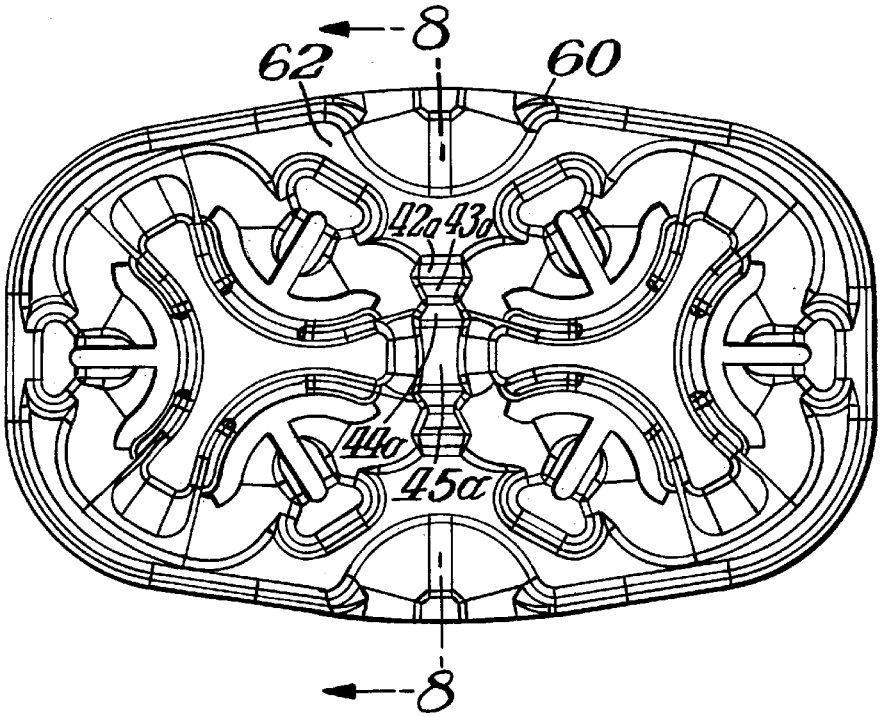
FIG. 7 is a top plan view of the embodiment shown in FIG. 6.
Figure 8:
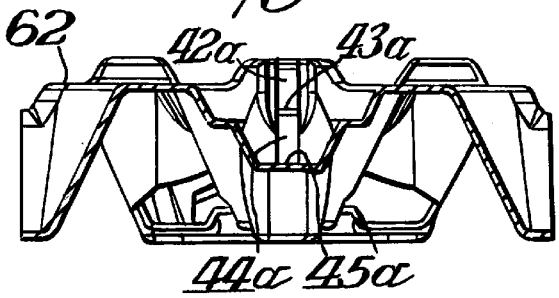
FIG. 8 is a cross-sectional end elevational view of the embodiment of FIG. 6 taken along line 8—8 in FIG. 7.

An alternate embodiment of the carrier of the invention is shown in FIGS. 6, 7 and 8. This embodiment differs from the first embodiment in overall configuration of the carrier, and in the structure of the support gusset 41. As seen in FIG. 7, the overall shape of the carrier is generally oval (the long sides are outwardly bowed) rather than rectangular, which increases the width of the shelves, as shown at 62. Also, as seen in FIGS. 6 and 8, the support gusset has a stepped structure, for increased rigidity. In particular, sloping wall 42*a* extends down to a first step 43*a*. Second sloping wall 44*a* extends down to a second step 45*a*, which is the lowermost portion of the surface of the support gusset. This arrangement of the support gusset has been found to provide excellent rigidity to the carrier against bending in the area between the two cups. This oval-shaped embodiment has been found to be very advantageous in preventing breaking or "hinging" when carrying larger sized cups.

As would be apparent to those in the art, the carrier can be formed to any desired thickness, and if composed of molded pulp, is preferably formed to a generally smooth finish. As would also be apparent, the shape of the carriers allows the carriers to be stacked (nested) with one another for convenient packaging, storing and shipping. The overall shape of the 2-cup carrier can vary greatly, while including the elements described above. For example, in some configurations, only one support leg, rather than two, would be required to adequately stabilize the carrier.

As another possible variation, only one of the two sockets need be provided with a flexible element, whereas the other socket could be in the nature of a solid cup.

What is claimed is:

1. A two cup beverage carrier having long sides and short sides comprising:

an upper surface and a lower surface;

two cup-receiving sockets, each socket having a floor and each socket being positioned at a different one of the short sides of the carrier, at least one socket being provided with at least one flexible element which exerts a stabilizing force on a cup inserted in the socket; and at least one stabilizing leg extending to the lower surface of the carrier, the leg being positioned at substantially the midpoint of the long side of the carrier.

2. The cup carrier of claim 1, further comprising a support gusset provided between the cup-receiving sockets.

3. The cup carrier of claim 2, provided with two stabilizing legs extending from the upper surface to the lower surface of the carrier, wherein the two stabilizing legs are positioned on opposing sides of the support gusset.

4. The cup carrier of claim 3, wherein the flexible elements in the cup-receiving sockets comprise bendable flanges which extend from at or above the upper surface of the carrier to a distance above the lower surface of the carrier.

5. The cup carrier of claim 4, wherein the flexible flanges are provided with slots which divide the flanges.

6. The cup carrier of claim 5, wherein elevated structures are associated with the upper surface of the carrier surrounding the sockets, and wherein the slots extend into the elevated structures.

7. The cup carrier of claim 6, wherein each socket is surrounded by three elevated structures.

8. The carrier of claim 3, wherein the stabilizing legs are provided with inwardly-curving surfaces to permit grasping of the carrier by one or both of the legs.

9. The cup carrier of claim 2, having a generally oval-shaped configuration with the long sides of the carrier being outwardly bowed.

10. The cup carrier of claim 2, wherein the support gusset has a height lower than the upper surface of the carrier.

11. The cup carrier of claim 10, wherein the support gusset has a stepped structure forming multiple upper surfaces.

12. A two-cup beverage carrier comprising:

an upper surface and a lower surface connected by sloping sidewalls;

two cup-receiving sockets formed by the sloping sidewalls, each socket being provided with flexible flange elements exerting a stabilizing force on a cup inserted in the socket;

shelves provided on the upper surface between the cup-holding sockets;

stabilizing legs extending from the shelves on the upper surface to the lower surface of the carrier on each side of the carrier between the cup-receiving sockets; and a support gusset provided between the cup-receiving sockets and between the shelves.

13. The cup carrier of claim 12, wherein the flexible flanges are provided with slots which bisect the flanges.

14. The cup carrier of claim 13, wherein the carrier is provided with elevated structures associated with the upper surface of the carrier surrounding the sockets, and wherein the slots extend into the elevated structures.

15. The cup carrier of claim 14, wherein each socket is surrounded by three elevated structures.

16. The carrier of claim 12, wherein the stabilizing legs are provided with inwardly-curving surfaces to permit grasping of the carrier by one or both of the legs.

17. The cup carrier of claim 12, having long sides and short sides, wherein the long sides of the carrier are outwardly bowed.

18. The cup carrier of claim 12, wherein the support gusset connects to the shelves by sloping walls, and the height of the support gusset is lower than the height of the upper surface of the carrier.

* * * * *